US005109923A

United States Patent [19]

Koleilat

[11] Patent Number: 5,109,923

[45] Date of Patent: May 5, 1992

[54] WELLHEAD BOWL PROTECTOR

[76] Inventor: Bashir M. Koleilat, 17826 Mahogany Forest, Spring, Tex. 77379

[21] Appl. No.: 683,937

[22] Filed: Apr. 11, 1991

[51] Int. Cl.[5] ..... E21B 17/10

[52] U.S. Cl. ..... 166/117; 166/242; 166/382; 285/45

[58] Field of Search ..... 166/77.5, 117, 242, 166/378, 379, 380, 382; 285/45; 175/307

[56] References Cited

U.S. PATENT DOCUMENTS 4,659,115 4/1987 Cameron ..... 166/77.5 X 4,688,632 8/1987 Cooley, Jr. ..... 166/77.5

*Primary Examiner*—William P. Neuder

*Attorney, Agent, or Firm*—W. William Ritt, Jr.; Richard B. Megley

[57] ABSTRACT

The invention relates to apparatus for protecting wellhead bores during drilling operations, and more particularly to bowl protectors for preventing damage to wellhead bore seal surfaces as drilling equipment passes through the wellhead. The invention includes a bowl protector and a seperable false bowl for accepting a casing hanger, the bowl protector and false bowl being releasably connected together by shear pins.

7 Claims, 3 Drawing Sheets

FIG_2
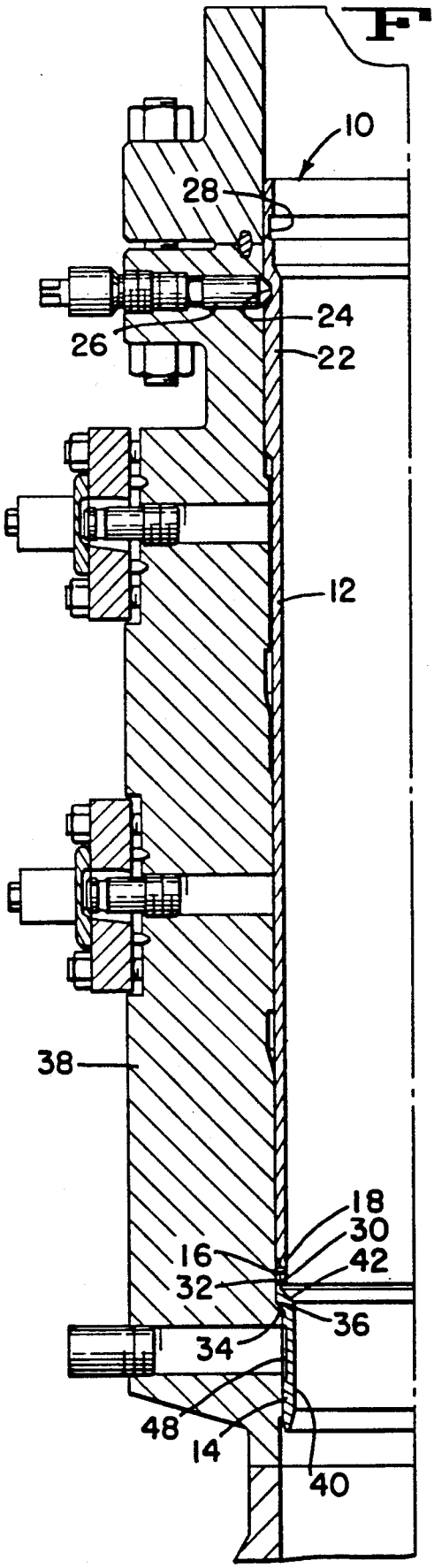
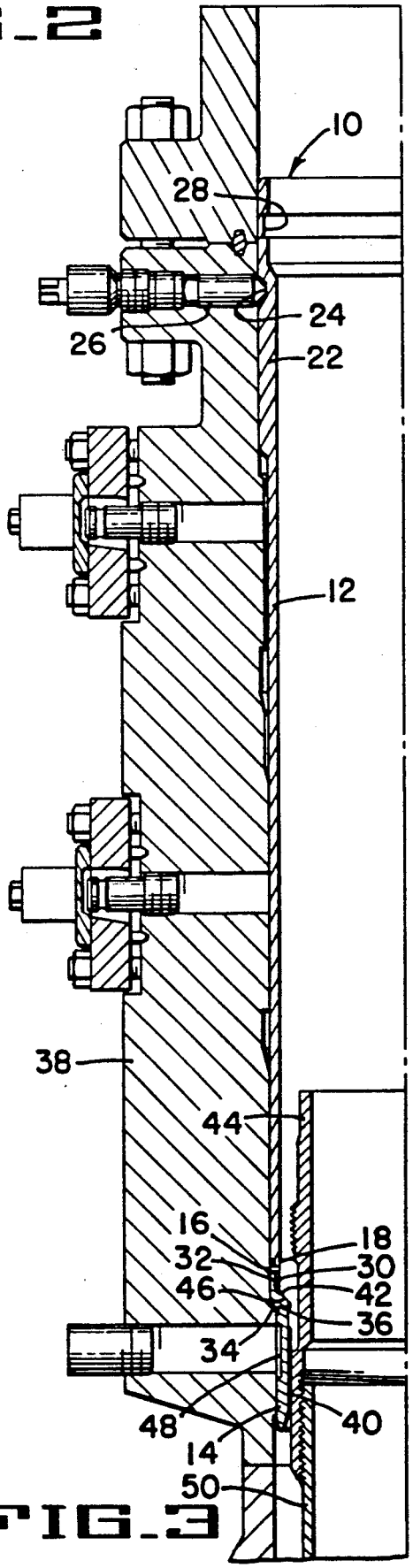
FIG_3

WELLHEAD BOWL PROTECTOR

BACKGROUND OF THE INVENTION

This invention relates to apparatus for protecting wellhead bores during drilling operations, and more particularly to bowl protectors for preventing damage to wellhead bore seal surfaces as drilling equipment passes through the wellhead.

A bowl protector comprises a generally elongated sleeve-like element that is traditionally installed temporarily in a wellhead bore to protect the bore sealing surfaces during a drilling operation. The bowl protector had to be removed, however, prior to running casing or tubing into the well to allow installation of the casing or tubing hangers in the wellhead. Removal of the bowl protector leaves the bore seal surfaces unprotected and thus highly vulnerable to damage by centralizers, casing collars and other equipment that must pass through the wellhead. This problem can become magnified in circumstances where the drilling rig is not perfectly centered over the well, a situation that occurs from time to time.

SUMMARY OF THE INVENTION

The present invention overcomes the foregoing problem by providing an assembly of a bowl protector and separable false bowl for accepting a casing hanger, the bowl protector and the false bowl being releasably connected together by shear pins. This assembly is run through the blowout prevent (BOP) and landed in the wellhead bore prior to running the casing, and an annular shoulder on the inner surface of the false bowl provides a seat for the casing hanger. The casing with its hanger is then run, the hanger landed on the seat in the false bowl, the hanger running tool retrieved, and a retrieving tool run and connected to the bowl protector. Upward pull applied to the bowl protector through the retrieving tool shears the pins and disconnects the bowl protector from the false bowl, facilitating retrieval of the bowl protector and continuance of drilling operations. If desired, the hanger running too can be provided with a latch mechanism to engage the bowl protector as the hanger is landed, whereby when the running tool is disconnected from the hanger the bowl protector can be separated from the false bowl and retrieved with the running tool by imposition of an upward pull on the running string, thereby avoiding a special trip to the wellhead to retrieve the bowl protector.

Another advantage to the present invention is that it eliminates ned for reciprocation of the casing. Previous methods to retrieve the conventional bowl protector involved incorporating a tool in the casing string that latches in the protector as the string is lowered. The string then had to be pulled back to the rig floor to remove the protector and tool, thus requiring reciprocation of the casing downhold and thereby increasing the possibility of a stuck casing.

The present invention results in the bowl protector having a dual function, namely to protect the bore in the wellhead and to serve as a running tool for the false bowl. Since the false bowl provides a smaller diameter seat for the casing hanger than the corresponding seat in he wellhead upon which the false bowl is supported, the outer diameter of the casing hanger can be reduced so that it drifts the inside diameter of the bowl protector. Another novel feature of the present invention is the provision of a system with a variable through bore, the larger bore incorporated in the wellhead design to allow passage of the drill bit and the smaller bore through the false bowl that allows passage of the casing string yet provides a seat or load shoulder for the casing hanger.

Further advantages of the present invention will become apparent from the following description of the preferred embodiment, taken in conjunction with the accompanying drawings.

BRIEF DESCRIPTION OF THE DRAWINGS

FIG. 2 is a fragmentary central section through a wellhead, showing the bowl protector/false bowl assembly of FIG. 1 installed therein.

FIG. 3 is a view like FIG. 2, showing a casing and its hanger installed in the wellhead with the hanger landed on the false bowl.

DESCRIPTION OF THE PREFERRED EMBODIMENT

Figure 1:
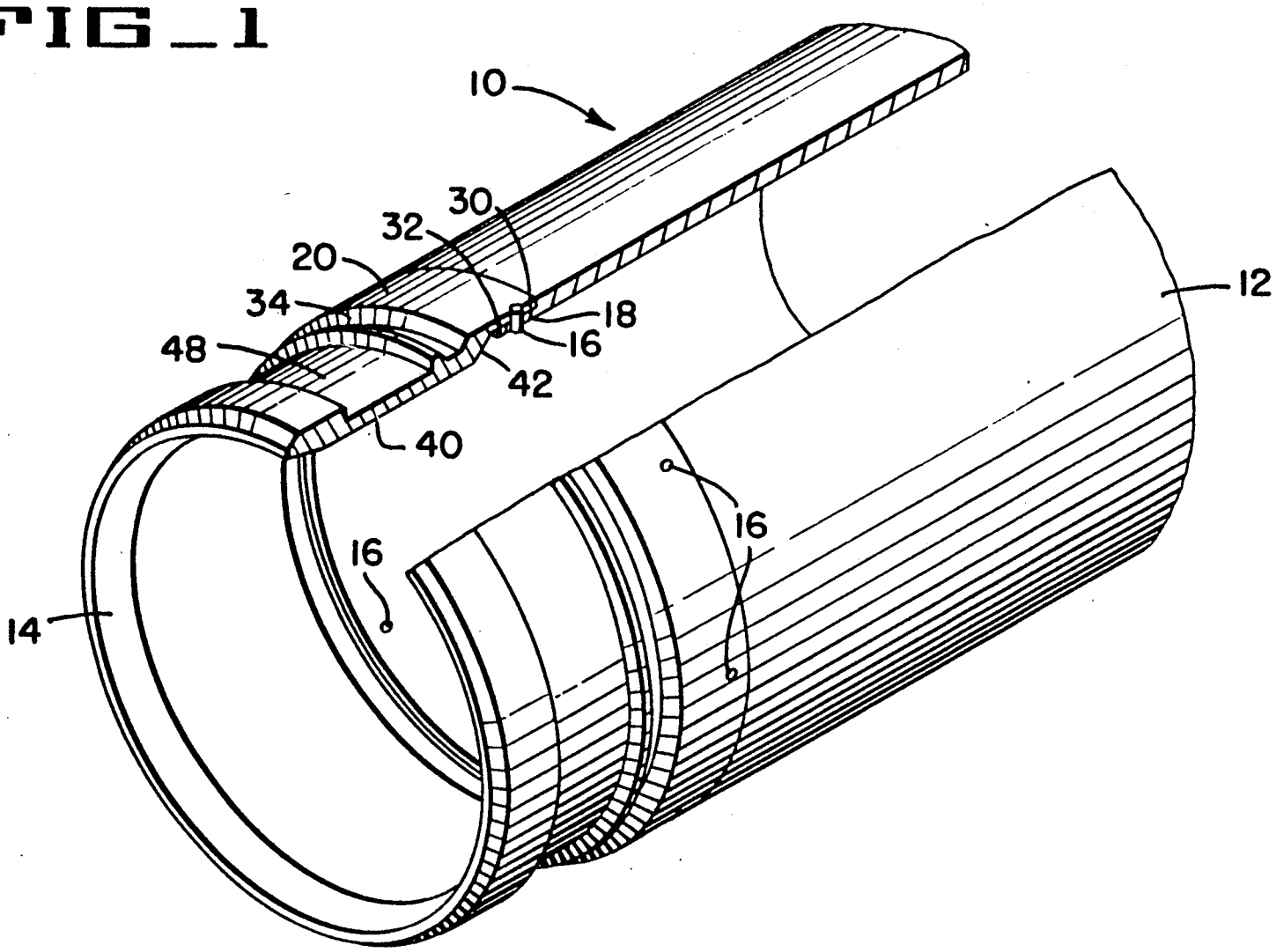
FIG. 1 is an isometric view of a bowl protector/false bowl assembly according to the present invention, with a portion broken away to better illustrate the configuration of the elements.

As seen best in FIG. 1, a bowl protector/false bowl assembly 10 according to the present invention comprises an elongated sleeve-like bowl protector 12, an annular false bowl 14 of lesser axial dimension than the bowl protector 12, and a plurality of circumferentially spaced shear pins 16 extending through the telescoped wall portions 18, 20 of the bowl protector and false bowl, respectively.

The bowl protector 12 has an upper end portion 22 (FIGS. 2 and 3) of increased well thickness, and in this portion 22 are an outer annular groove 24 for receiving a plurality of circumferentially spaced lockdown screws 26 (only one shown), and an inner annular groove 28 for connecting the bowl protector to a retrieving tool (not shown). The lower end portion 18 of the bowl protector has a reduced outside diameter 30 which fits inside the upper end portion 32 of the false bowl when these elements are assembled (FIGS. 1 and 2).

Figure 4:
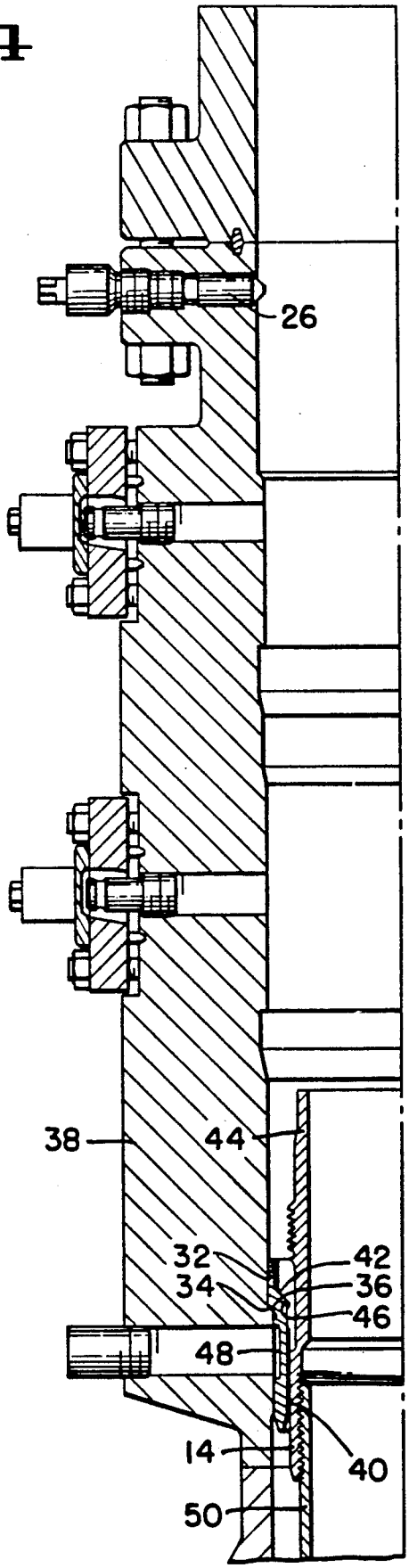
FIG. 4 is a view like FIG. 3, but showing the installation after the bowl protector has been retrieved.

The false bowl 14 has an outer annular shoulder 34 that lands on an inner annular seat 36 in the wellhead 38 (FIGS 2–4), the seat 36 thereby supporting the false bowl/bowl protector assembly 10 in the wellhead. The inner surface 40 of the false bowl includes an annular shoulder 42 that functions as a seat for a casing hanger 44 (FIGS. 3 and 4), the hanger having an outer annular shoulder 46 that lands on the false bowl shoulder 42. The outer surface of the false bowl has a reduced diameter portion 48 to minimize the relatively tight contact between the false bowl and the wellhead in that area yet leaving sufficient contact surface to assure proper centralization of the false bowl in the wellhead.

INSTALLATION PROCEDURE

The bowl protector/false bowl assembly 10 is installed by connecting it to a pipe string (not shown) and running it into the wellhead 38 until the shoulder 34 on the false bowl lands on the seat 36 in the wellhead. The lockdown screws 26 are then threaded inwardly into the bowl protector groove 24, thereby securing the assembly in functional position in the wellhead. The casing hanger 44 and attached casing string 50 are then run into the wellhead and the hanger shoulder 46 landed on the false bowl shoulder 42. Backing out the lock-down screws 26 from the bowl protector groove 24 frees the protector for retrieval that is accomplished by connecting onto the protector with a retrieval tool (not shown) and pulling up on the running string. This shears the shear pins 16, whereby the false bowl 14 remains in place in the wellhead (FIG. 4) and the bowl protector is retrieved to the drilling rig.

Although the best mode contemplated for carrying out the present invention has been herein shown and described, it will be apparent that modification and variation may be made without departing from what is regarded to be the subject matter of the invention.

What is claimed is:

1. A well tool for protecting the bore of a wellhead and for providing a seat in the wellhead to support a pipe hanger therein, said tool comprising an assembly of:

a) an elongated, sleeve-like bowl protector having means for connection to a pipe string for running said protector into and retrieving it from a wellhead;

b) an annular false bowl having support means on its outer surface for cooperation with an annular seat in a wellhead bore to support said false bowl in said bore, and seat means on the inner surface of said false bowl for supporting a pipe hanger thereon; and c) means releasably connecting the bowl protector to the false bowl and being releasable upon exertion of a predetermined axial force on the bowl protector while the false bowl is held stationary.

2. A well tool according to claim 1 wherein the false bowl support means comprises ann annular downwardly-facing shoulder.

3. A well tool according to claim 1 wherein the false bowl seat means comprises an upwardly-facing annular surface.

4. A well tool according to claim 1 wherein the means releasably connecting the bowl protector to the false bowl comprises a shear pin system.

5. A well tool according to claim 4 wherein the shear pin system comprises a plurality of circumferentially spaced shear pins.

6. A well tool according to claim 1 wherein the bowl protector includes means for cooperating with a wellhead component to secure the protector against axial movement in, and with respect to, the wellhead.

7. A well tool according to claim 6 wherein the bowl protector cooperating means comprises an annular groove in the outer surface of said protector.

* * * * *